US012246941B2

(12) United States Patent
Ishioka

(10) Patent No.: US 12,246,941 B2
(45) Date of Patent: Mar. 11, 2025

(54) SHEET FEEDING DEVICE

(71) Applicant: CANON KABUSHIKI KAISHA, Tokyo (JP)

(72) Inventor: Naoki Ishioka, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 17/367,805

(22) Filed: Jul. 6, 2021

(65) Prior Publication Data

US 2022/0041389 A1 Feb. 10, 2022

(30) Foreign Application Priority Data

Aug. 4, 2020 (JP) ..... 2020-132530

(51) Int. Cl.
*B65H 5/06* (2006.01)
*B65H 7/02* (2006.01)
(Continued)

(52) U.S. Cl.
CPC ..... *B65H 9/006* (2013.01); *B65H 5/062* (2013.01); *B65H 7/02* (2013.01); *B65H 85/00* (2013.01);
(Continued)

(58) Field of Classification Search
CPC ..... B65H 5/062; B65H 9/006; B65H 85/00; B65H 2404/1441; B65H 2511/416; B65H 2511/414
See application file for complete search history.

(56) References Cited

U.S. PATENT DOCUMENTS 5,222,723 A * 6/1993 Ijuin ..... H04N 1/00657 271/10.11
7,857,308 B2 * 12/2010 Nakazawa ..... B65H 9/16 271/228
(Continued)

FOREIGN PATENT DOCUMENTS

JP 2019-026453 A 2/2019
JP 2020-075802 A 5/2020
JP 2020-083523 A 6/2020

OTHER PUBLICATIONS

Jun. 4, 2024 Japanese Official Action in Japanese Patent Appln. No. 2020-132530.
(Continued)

*Primary Examiner* — Patrick Cicchino
(74) *Attorney, Agent, or Firm* — Venable LLP

(57) ABSTRACT

A sheet feeding device includes a feeding portion, a first feeding roller pair, a registration roller pair forming a nip portion and correcting oblique movement of the sheet, a sheet feeding passage between the first feeding roller pair and the registration roller pair, a revering portion provided downstream of the registration roller pair and a second feeding roller pair feeding the reversed sheet to the registration roller pair. The second roller pair includes a driven roller movable in a sheet width direction. The nip portion of the first feeding roller pair is in a spaced state when the sheet is fed by the registration roller pair, and a nip portion of the second feeding roller pair is not in the spaced state and the driven roller moves in the sheet width direction when the sheet is fed by the registration roller pair and the second feeding roller pair.

7 Claims, 9 Drawing Sheets

(51) Int. Cl.
*B65H 9/00* (2006.01)
*B65H 85/00* (2006.01)

(52) U.S. Cl.
CPC ..... *B65H 2404/1441* (2013.01); *B65H 2511/416* (2013.01)

(56) References Cited

U.S. PATENT DOCUMENTS

| | | | | |
|---|---|---|---|---|
| 7,942,411 | B2 | 5/2011 | Ishioka | |
| 8,382,101 | B2 | 2/2013 | Ishioka | |
| 8,820,738 | B2 * | 9/2014 | Deno | B65H 9/006 271/272 |
| 8,851,471 | B2 * | 10/2014 | Yamazaki | B65H 9/002 271/228 |
| 10,106,355 | B2 * | 10/2018 | Sato | B65H 5/062 |
| 10,618,760 | B2 | 4/2020 | Ishioka et al. | |
| 2008/0054553 | A1 * | 3/2008 | Muneyasu | B65H 7/10 271/240 |
| 2019/0177102 | A1 * | 6/2019 | Yamaguchi | G03G 15/6529 |
| 2020/0156890 | A1 | 5/2020 | Takane et al. | |

OTHER PUBLICATIONS

Dec. 3, 2024 Japanese Official Action in Japanese Patent Appln. No. 2020-132530.

* cited by examiner

SHEET FEEDING DEVICE

FIELD OF THE INVENTION AND RELATED ART

The present invention relates to a sheet feeding device which feeds sheets.

Conventionally, some sheet feeding devices which feeds sheets are equipped with a configuration which corrects oblique movement by adjusting sheet direction and position. The configuration to correct oblique movement of sheets is that correcting oblique movement of a leading end of a sheet by abutting the leading end of the sheet with a nip portion of a registration roller pair which is remaining stationary and forming a loop of the sheet at upstream of the registration roller pair.

However, in a sheet feeding process after correcting oblique movement of the leading end of the sheet, buckling or oblique movement of the sheet may occur due to a difference in loop shape (distortion) in a sheet width direction perpendicular to a sheet feeding direction. Especially, a buckling of a sheet is more remarkable in thin sheets with small basis weight, and wrinkles may occur in the sheet. In Japanese Laid-Open Patent Application (JP-A) 2020-83523, a technology to avoid wrinkling and oblique movement of sheets by spacing away the feeding nip portion of the feeding roller pair at upstream from the registration roller pair and not restricting the sheets by the feeding roller pair at the rear end of the sheets, when the registration roller pair feeds the sheets, is disclosed. In addition, there is a configuration in which, in order to feed sheets to the registration roller pair, a second feeding passage is provided to feed the sheets that have passed through the first feeding passage and have been reversed, back to the registration roller pair, besides a first sheet feeding passage that feeds sheets from a feeding portion that feeds the sheets to the registration roller pair. Furthermore, a first feeding roller pair provided at upstream of the registration roller pair in the first feeding passage and a second feeding roller pair provided at upstream of the registration roller pair in the second feeding passage may be configured with different roller pairs.

In this case, the obliqueness of the sheets passing through the second feeding passage is small because oblique movement of the leading end of the sheets is corrected once the sheets pass through the first feeding passage. Therefore, configuring the nip portion of the second feeding roller pair in the second feeding passage so that they space away from each other may increase the cost and the size of the device due to an increase in the number of parts.

SUMMARY OF THE INVENTION

An object of the present invention is to provide a sheet feeding device to reduce oblique movement of a sheet in a feeding process after correcting oblique movement of the sheet.

According to an aspect of the present invention, there is provided a sheet feeding device comprising a feeding portion configured to feed a sheet accommodated therein, a first feeding roller pair configured to nip and feed the sheet fed by said feeding portion, a registration roller pair configured to nip and feed the sheet by forming a nip portion, said registration roller pair correcting oblique movement of the sheet by abutting a leading end of the sheet fed by said first feeding roller pair against said nip portion which is remaining stationary, a sheet feeding passage, provided between said first feeding roller pair and said registration roller pair with respect to a sheet feeding direction, through which the sheet fed by said first feeding roller pair is passed, a revering portion provided downstream of said registration roller pair with respect to the sheet feeding direction and configured to reverse the sheet, and a second feeding roller pair configured to nip and feed the sheet reversed by said reversing portion to said registration roller pair so as to merge with said sheet feeding passage at downstream of said first feeding roller pair and at upstream of said registration roller pair, wherein said second roller pair includes a feeding roller for feeding the sheet and a driven roller driven by rotation of said second feeding roller pair, wherein said nip portion of said first feeding roller pair is capable of being spaced away and said driven roller is movable with respect to a sheet width direction perpendicular to the sheet feeding direction, and wherein said nip portion of said first feeding roller pair is in a spaced state when the sheet fed by said first feeding roller pair is fed by said registration roller pair, and a nip portion of said second feeding roller pair is not in the spaced state and said driven roller moves with respect to the sheet width direction when the sheet fed by said second feeding roller pair is fed by said registration roller pair and said second feeding roller pair.

Further features of the present invention will become apparent from the following description of exemplary embodiments (with reference to the attached drawings).

Figure 3:
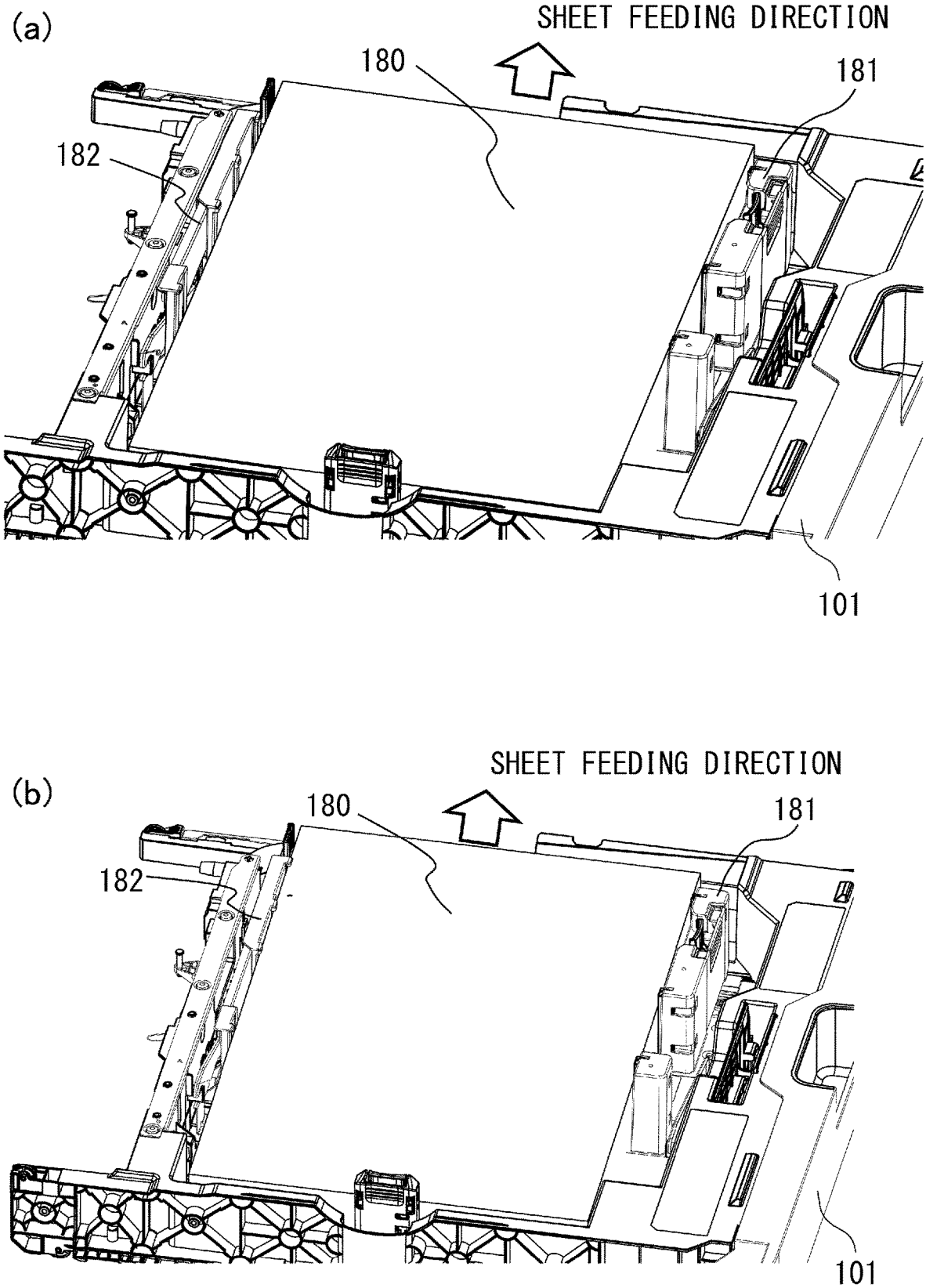

Part (a) of FIG. 3 is a perspective view showing a state that there is a gap between sheets stored in a accommodating container and a side regulating plate. Part (b) of FIG. 3 is a perspective view showing a state that there is no gap between sheets stored in a accommodating container and a side regulating plate.

Figure 4:
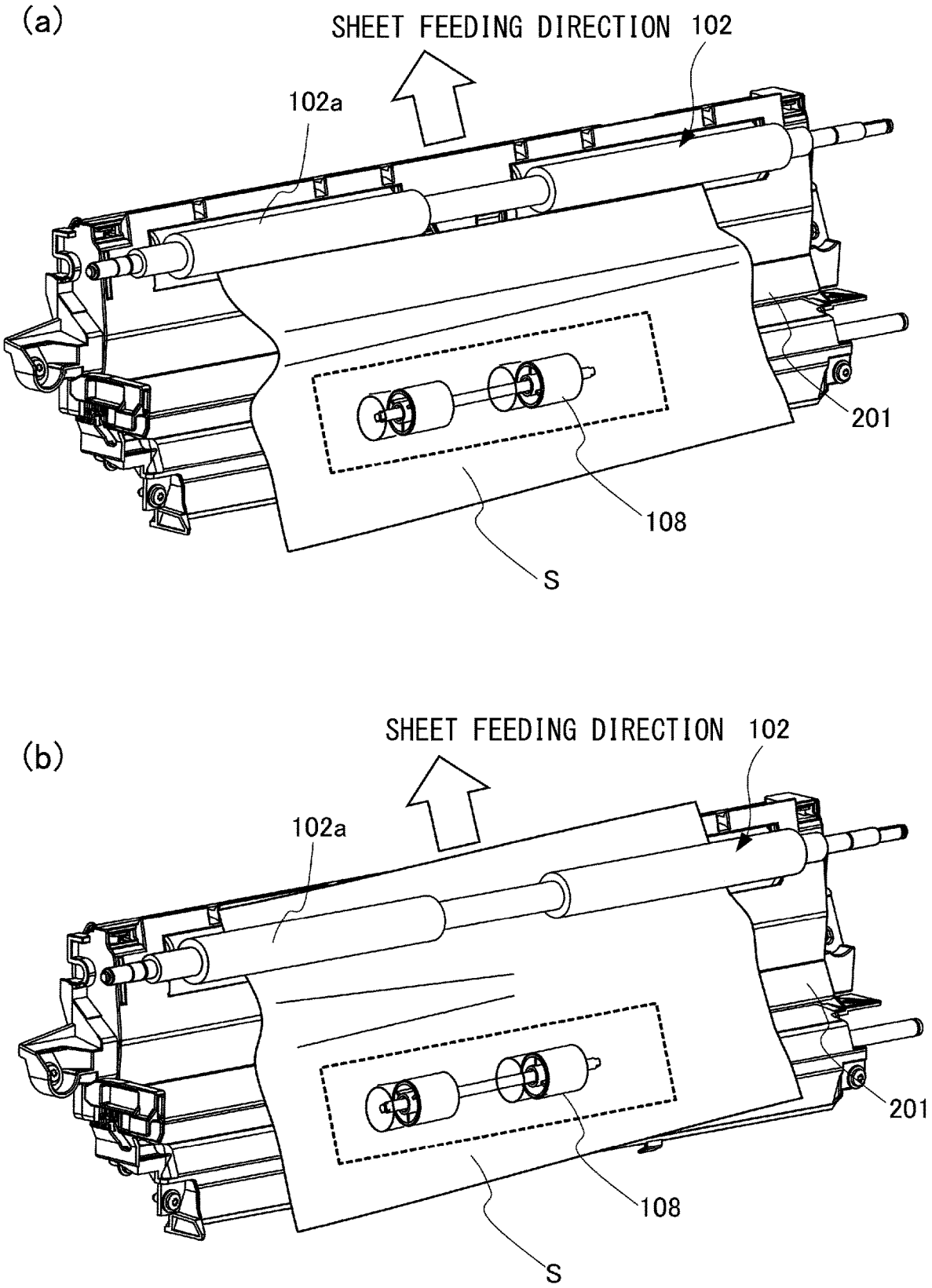

Part (a) of FIG. 4 is a perspective view of a single-side feeding passage showing a state that a sheet has distortion during correcting oblique movement of the sheet.

Part (b) of FIG. 4 is a perspective view of a single-side feeding passage showing a state that distortion of a sheet is returned after correcting oblique movement of the sheet.

Figure 5:
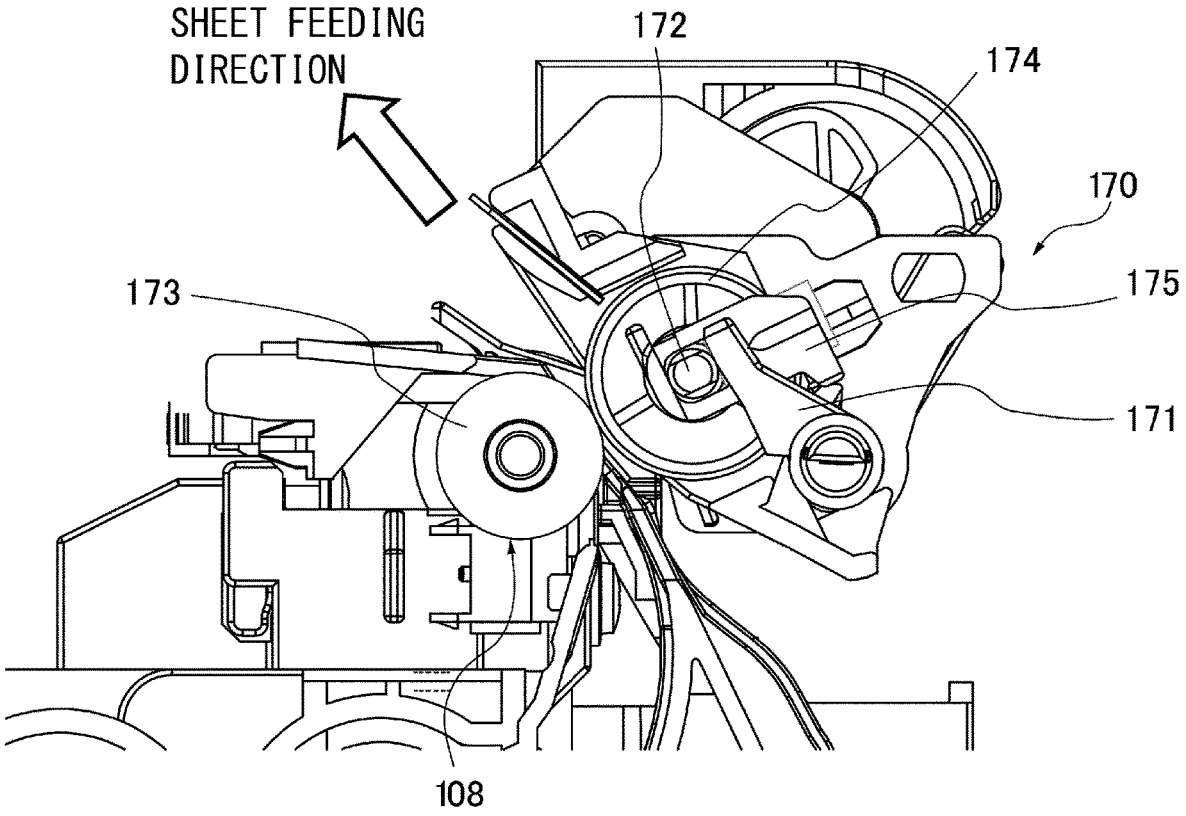

FIG. 5 is a sectional view of a spacing mechanism of a single-side feeding passage according to the first embodiment.

Figure 6:
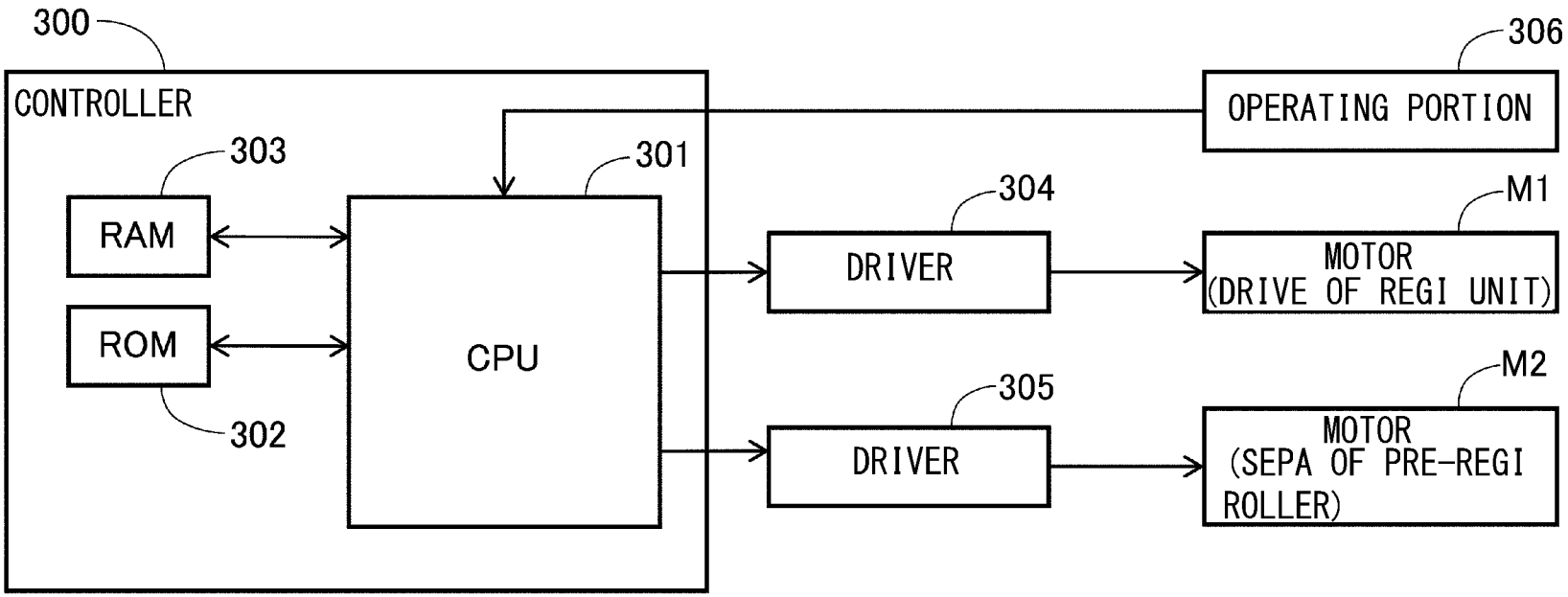

FIG. 6 is a control block diagram with regard to sheet feeding according to the first embodiment.

Figure 7:
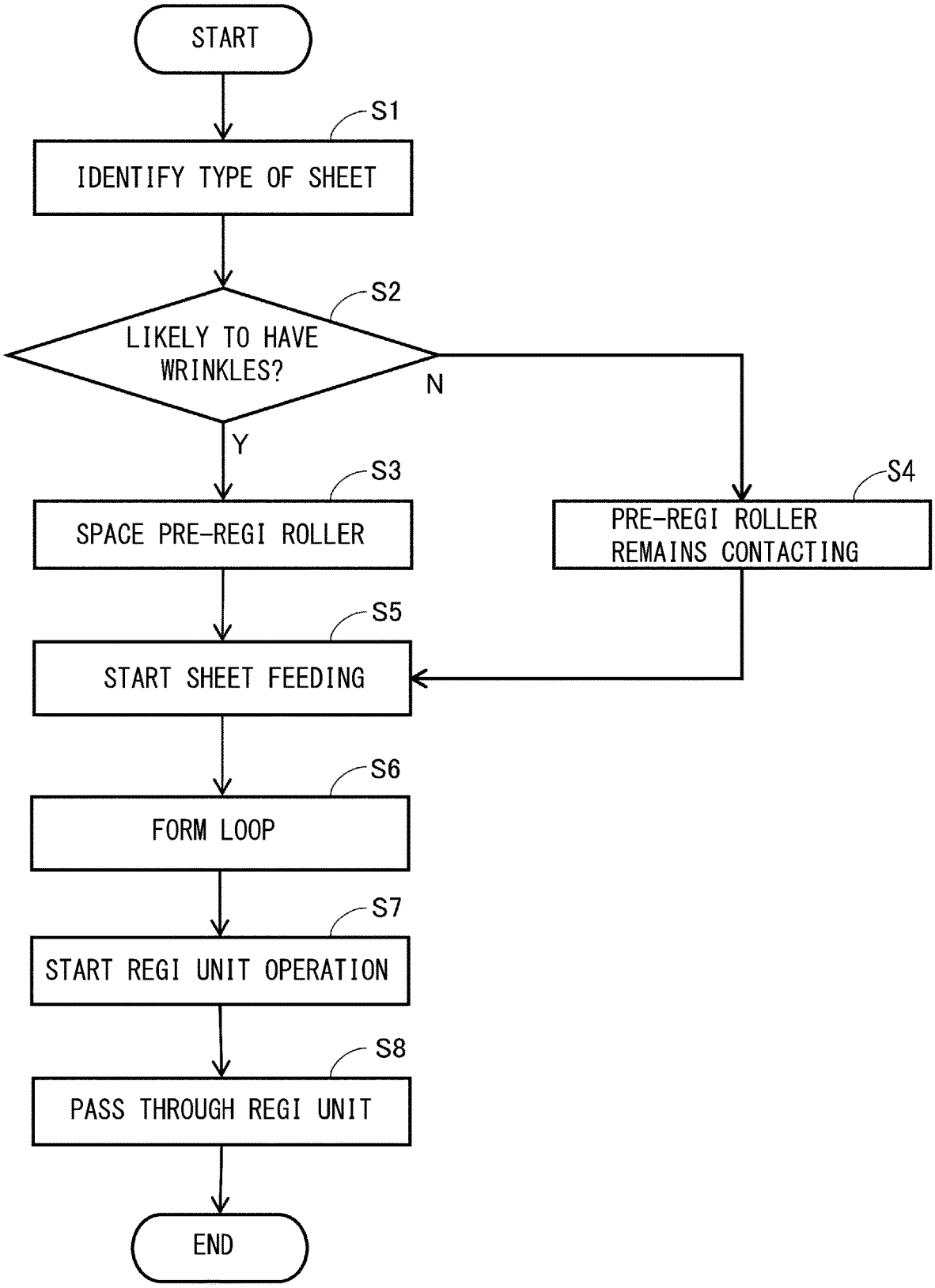

FIG. 7 is a flowchart of control with regard to sheet feeding according to the first embodiment.

Figure 8:
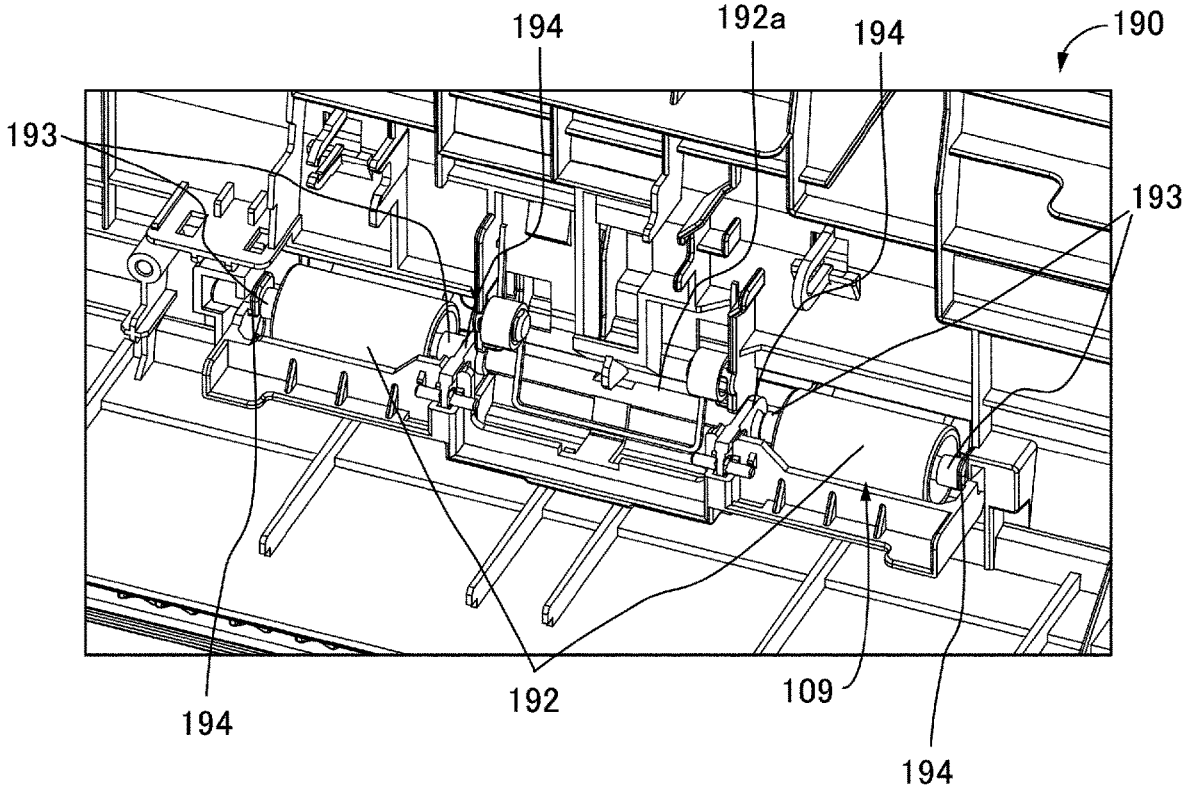

FIG. 8 is a perspective view of a moving mechanism of a double-side feeding passage according to the first embodiment.

Figure 9:
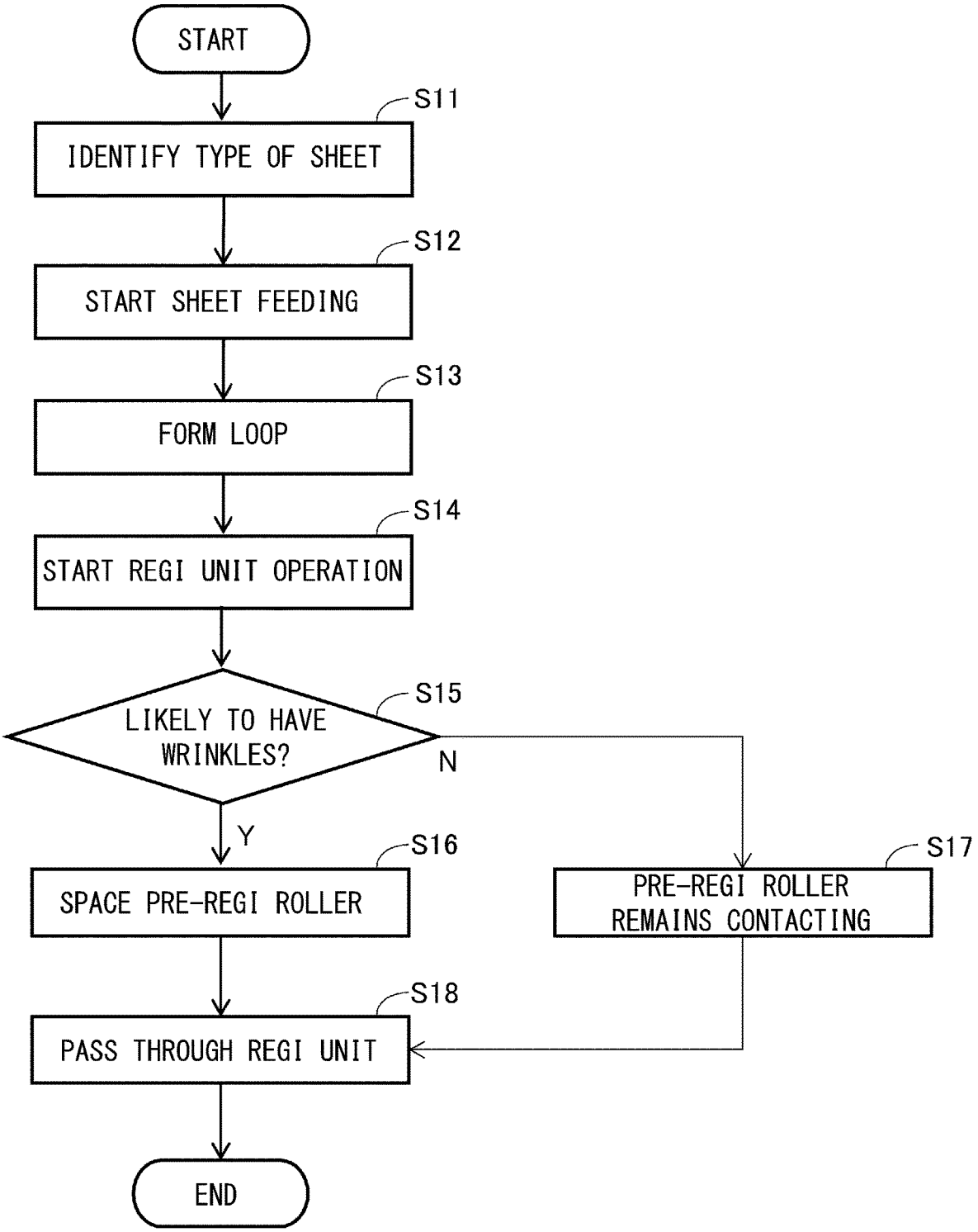

FIG. 9 is a flowchart of control with regard to sheet feeding according to a second embodiment.

DESCRIPTION OF THE EMBODIMENTS

First Embodiment

A first embodiment of the present invention will be described with reference to FIG. 1 through FIG. 8. First of all, a schematic configuration of an image forming apparatus will be described with reference to FIG. 1.

[Image Forming Apparatus]

An image forming apparatus 100 of this embodiment is a color printer applying an electrophotographic method, and employs an intermediary transfer tandem method in which a plurality of (four in case of this embodiment) image forming portions 120 are arranged along on an intermediary transfer belt 130. The image forming apparatus 100 with the method as described above has advantages such as excellent adaptability to a wide variety of recent sheets S and high print productivity. The sheets S include paper, plastic film, cloth, and other sheet materials.

The sheets S are stored in a accommodating container 101 as a storage portion. The accommodating container 101 is provided with a lift-up portion that lifts up the sheets, and the sheets S in the accommodating container 101 are stacked on the lift-up portion. The sheet S stored in the accommodating container 101 is fed to a single-side feeding passage 201 as a first feeding passage by a feeding portion 106 which is comprised of a pair of rollers.

A registration unit 102 as an oblique movement correction portion and a first registration pre-roller pair 108 as a first rotatable member pair are arranged in the single-side feeding passage 201. The first registration pre-roller pair 108 nips and feeds the sheets at the upstream side of the sheet feeding direction of the registration unit 102. The sheet S fed to the single-side feeding passage 201 by the feeding portion 106 passes through the first registration pre-roller pair 108 and oblique movement of the sheet S is corrected in the registration unit 102. Then, the sheet S passes through the feeding unit, and is sent to a secondary transfer portion 103.

The secondary transfer portion 103 is a transfer nip portion of a toner image to the sheet S formed by an opposing secondary transfer inner roller 104, an intermediary transfer belt 130, and a secondary transfer outer roller 105. In the secondary transfer portion 103, an unfixed image is attracted from an intermediary transfer belt 130 to the surface of the sheet S by applying a predetermined pressure and an electrostatic additional bias. The single-side feeding passage 201 for feeding the sheet S is comprised of a sheet feeding portion (such as a roller pair, an attraction belt) arranged at appropriate intervals for feeding the sheet S while nipping it, and a sheet guide 107 which guides the sheet S while controlling its movement.

The registration unit 102 is a pair of registration rollers, and has a function of correcting oblique movement of the sheet S by aligning the leading end of the sheet S in the way of abutting against the sheet S which is fed by the first registration pre-roller pair 108 and forming a loop. The registration unit 102 also has a function of feeding the sheet S to the secondary transfer portion 103 at a timing of image formation on the sheet S, that is, a predetermined timing according to the toner image borne on the intermediary transfer belt 130. After correcting the oblique movement of the sheet S, the registration unit 102 feeds the sheet S to the secondary transfer portion 103 at a desired timing.

A process of forming an image, which is sent to the secondary transfer portion 103 at a same timing of a feeding process of sheet S to the secondary transfer portion 103 as described above, will be described. The image forming portion 120 is mainly comprised of a photosensitive drum 121 as an image bearing member, a charging device 122, an exposure device 123, a developing device 124, a primary transfer device 125, and a drum cleaner 126. The photosensitive drum 121 is a cylindrical photosensitive body and is rotationally driven in the direction of arrow A in FIG. 1. The surface of the photosensitive drum 121 is uniformly charged in advance by the charging device 122. Then, the exposure device 123 is driven based on an image information signal sent from a connected PC (personal computer), an image reading device, etc., the exposure light is irradiated to the surface of the rotating photosensitive drum 121, and an electrostatic latent image is formed on the surface of the photosensitive drum 121.

The electrostatic latent image formed on the photosensitive drum 121 is developed as a toner image on the photosensitive drum 121 through toner development by the developing device 124. Then, the toner image is transferred onto the intermediary transfer belt 130 as the image bearing member by applying a predetermined pressure and electrostatic load bias by the primary transfer device 125.

Figure 1:
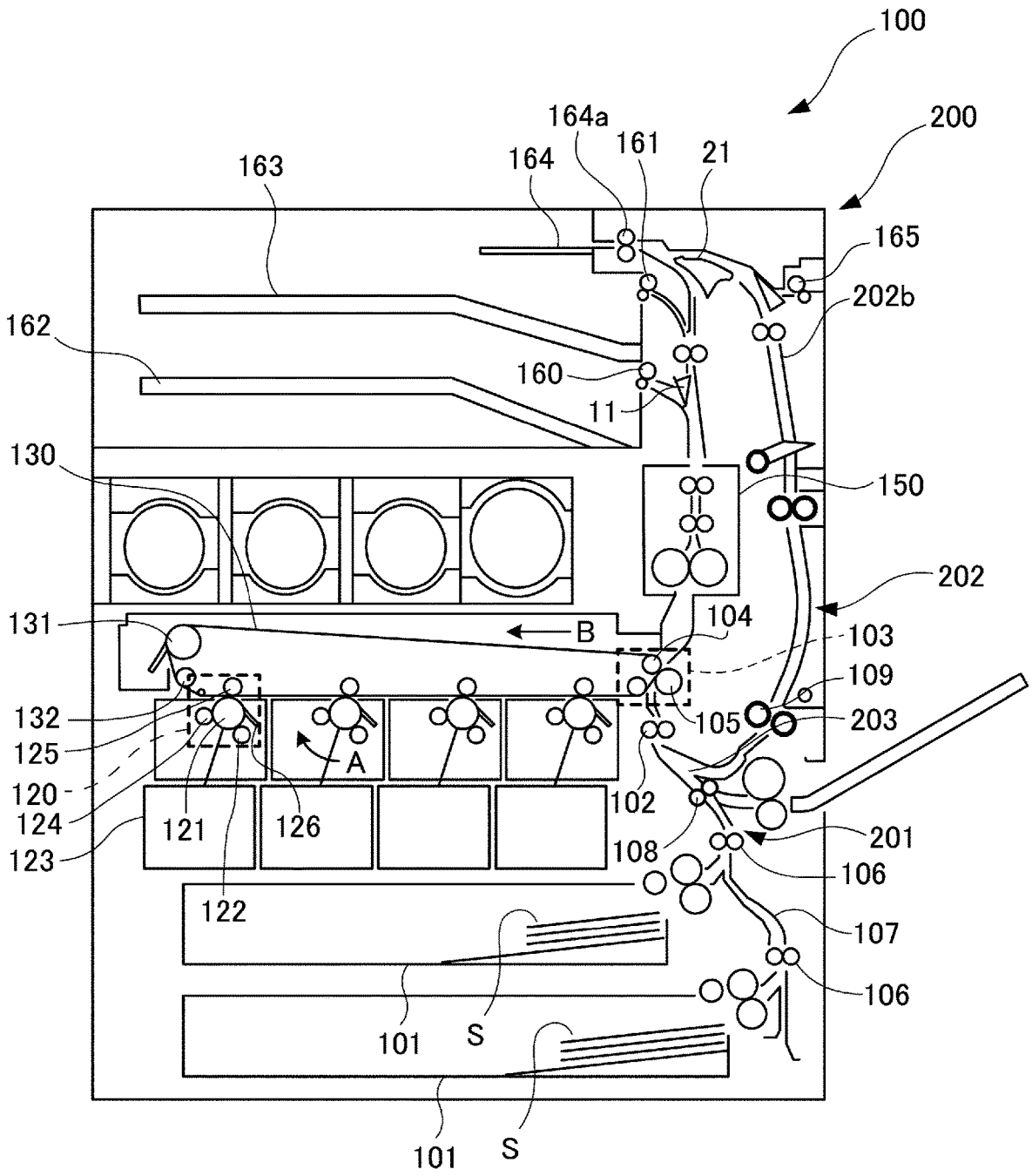
FIG. 1 is a sectional view showing a schematic configuration of an image forming apparatus according to a first embodiment of the present invention.

After that, a small amount of residual transfer toner remaining on the photosensitive drum 121 is collected by the drum cleaner 126 and prepared for the next image formation. In the case of FIG. 1, there are four sets of the image forming portions 120 as described above: yellow (Y), magenta (M), cyan (C) and black (Bk). However, the number of colors is not limited to four, and the order of the colors is also not limited to this.

The intermediary transfer belt 130 will be described. The intermediary transfer belt 130 is an endless belt, and is stretched by rollers such as a driving roller 131, a tension roller 132, and a secondary transfer inner roller 104, and is fed and driven in the direction of arrow B in FIG. 1. The image forming process of each color, which is processed in parallel by the image forming portions 120 of Y, M, C and Bk as described above, is performed at a timing to superimpose on a toner image of an upstream color which has been primary transferred on the intermediary transfer belt 130. In the end, a full-color toner image is formed on the intermediary transfer belt 130 and fed to the secondary transfer portion 103.

Through a feeding process of the sheet S and an image forming process of the sheet S as described above, a full-color toner image is secondarily transferred onto the sheet S in the secondary transfer portion 103, and then the sheet S is fed to a fixing device 150. The fixing device 150 melts and fixes the toner image on the sheet S by applying a predetermined pressure by opposing rollers or a belt, etc., and a heating effect by a heat source such as a heater in general.

The sheet S with a fixed image obtained as described above is selectively discharged to discharge trays 162 and 163 through discharge portions 160 and 161 by a switching member 11. Alternatively, if double-side image formation is required, a passage selection is made by a switching member 21 to be fed from a reversing portion 164 to a discharge feeding passage 165 or a double-side feeding passage 202 as a second feeding passage.

The reversing portion 164 is provided with a feeding roller pair **164*a*, and stops the feeding roller pair 164*a* during feeding the sheet S after the sheet S fed from the single-side feeding passage 201 through the switching member 21 has reached the feeding roller pair 164*a*. Then, the sheet S is fed to the double-side feeding passage 202 by reverse rotation of the feeding roller pair 164*a*. The sheet S fed into the double-side feeding passage 202 is fed again to the secondary feeding portion 103 with the front and back reversed, and after the toner image is secondarily transferred to the back side in the same way as described above, the toner image is fixed by the fixing device 150. Then, the sheet S is selectively discharged to the discharge trays 162 and 163**.

[Sheet Feeding Portion]

Figure 2:
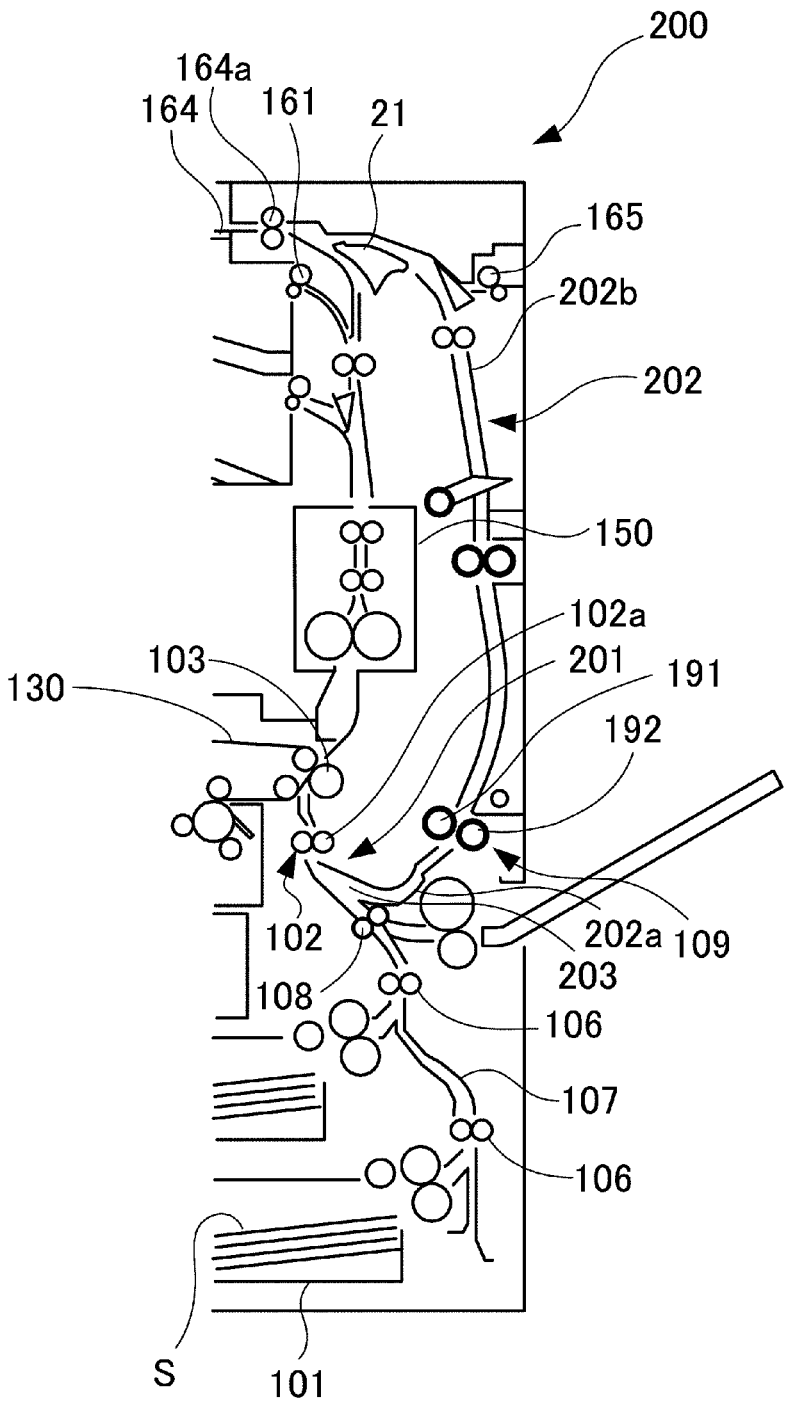
FIG. 2 is a sectional view showing a schematic configuration of a sheet feeding portion according to the first embodiment.

A sheet feeding portion 200 as a sheet feeding device provided with the single-side feeding passage 201 and the double-side feeding passage 202 will be described with reference to FIG. 2. The single-side feeding passage 201 includes the registration unit 102 as an oblique movement correction portion and a first registration pre-roller pair 108 as a first rotator pair, as described above. The registration pre-roller pair 108 feeds the sheet toward the registration unit 102 in the single side feeding passage 201. The registration unit 102 is a registration roller pair comprised of a pair of rollers 102*a*, and corrects oblique movement of the sheet S by abutting the sheet S fed by the first registration pre-roller pair 108 against the registration unit 102 while its rotation is stopped. The registration unit 102 starts feeding the sheet S at a predetermined timing after the sheet abuts against it. That is, a sheet feeding is started in accordance with a timing when the toner image on the intermediary transfer belt 130 reaches the secondary transfer portion 103.

Meanwhile, the double-side feeding passage 202 includes a second registration pre-roller pair 109 as a second rotatable member pair. The second registration pre-roller pair 109 is comprised of a driving roller 191 and a driven roller 192, which are a pair of rollers, and nips and feeds the sheet. The double-side feeding passage 202, similar to the single-side feeding passage 201, is comprised of a sheet feeding portion (such as a pair of rollers, an attraction belt) arranged at appropriate intervals for feeding the sheet S while nipping it sheet and a sheet guide 202*b* which guides the sheet S while controlling its movement.

The double-side feeding passage 202, where the sheet S that has been reversed in the reversing portion 164 is fed, merges with the single-side feeding passage 201 at a merging portion 203 positioned between the registration unit 102 and the first registration pre-roller pair 108. The double-side feeding passage 202 includes a curved portion 202*a* which is at downstream in the sheet feeding direction of the second registration pre-roller pair 109 and is curved toward the merging portion 203. The curved portion 202*a* in FIG. 2 is a portion in which the sheet guide 202*b* is curved so that the sheet S, which is fed generally downward in the double-side passage 202, can be smoothly reached to the single-side feeding passage 201 which feeds the sheet generally upward. That is, the curved portion 202*a* has a shape which makes the sheet to U-turn.

[A Movement of the Sheet in the Single-Side Feeding Passage]

A movement of the sheet in the single-side feeding passage 201 will be described with reference to part (a) of FIG. 3 through (b) of FIG. 4. A relationship between a sheet bundle 180 stored in the accommodating container 101 and side regulating plates 181 and 182 will be described with reference to FIG. 3, parts (a) and (b). The side regulating plates 181 and 182 are arranged on both sides in a width direction of the sheet bundle 180 stacked in the accommodating container 101, and regulate positions of both ends in the width direction of the sheet bundle. The width direction is a width direction of the sheet that intersects with (perpendicular to in this embodiment) a sheet feeding direction in which the sheet S is fed.

If a user sets a sheet in the accommodating container 101, the sheet may be set with a gap between the sheet bundle 180 which is set and the side regulating plates 181 and 182, as shown in part (a) of FIG. 3. This gap between the sheet bundle 180 and the side regulating plates 181 and 182 causes the leading end of the sheet S or the rear end of the sheet S to move in the width direction by this gap, and the sheet S is fed in an oblique direction with respect to the sheet feeding direction. In this case, as shown in part (b) of FIG. 3, an amount of oblique movement (inclination of the sheet with respect to the sheet feeding direction) of the sheet to be fed becomes larger than in a case that there is almost no gap between the sheet bundle 180 and the side regulating plates 181 and 182.

The sheet S in the accommodating container 101 is fed to the single-side feeding passage 201 and the registration unit 102 corrects oblique movement of the sheet S. In a case that there is a gap between the sheet bundle 180 and the side regulating plates 181 and 182 as shown in part (a) of FIG. 3, the registration unit 102 needs to correct larger oblique movement of the sheet S to be fed, than a case in part (b) of FIG. 3. If large oblique movement of the sheet S is corrected, a large distortion in a loop shape of the sheet S will occur by abutting the leading end of the sheet S against the registration unit 102, as shown in (a) of FIG. 4.

That is, if the registration unit 102 corrects oblique movement of the sheet S, a loop of the sheet S is formed between the registration unit 102 and the first registration pre-roller pair 108. Then, the leading end of the sheet S is abutted against the registration unit 102 by an opposing force that attempts to return the loop shape of the sheet S. This causes the leading end of the sheet S to align a nip line of the pair of rollers 102*a* of the registration unit 102, and correct oblique movement of the leading end of the sheet S. As shown in part (a) of FIG. 4, a distortion due to different loop amounts with regard to the width direction of the sheet S occurs by correcting oblique movement of the sheet S.

If the roller 102*a* of the registration unit 102 rotates and feeds the sheet S in such a distorted loop shape, buckling or return of oblique movement of the sheet S may occur, as shown in part (b) of FIG. 4. Especially in a case of thin paper, buckling of the sheet S causes significant creases. The return of oblique movement is a movement that attempts to return the leading end of the sheet S to an angle of the rear end of the sheet S. Thus, in this embodiment, a spacing mechanism 170 is provided which can space away the first registration pre-roller pair 108 at upstream of the registration unit 102 in a sheet feeding direction.

[Spacing Mechanism]

The spacing mechanism 170 of the first registration pre-roller pair 108 will be described with reference to FIG. 5. The first registration pre-roller pair 108 is comprised of a driving roller 173 and the driven roller 174 as a pair of rollers. The driven roller 174 is rotated with regard to the driving roller 173 around a rotation shaft 172. The sheet is nipped and fed between the driving roller 173 and the driven roller 174. The spacing mechanism 170 includes a spacing cam 171 and a link member 175. The spacing cam 171 is rotationally driven by a motor M2 (FIG. 6 as described below). The link member 175 is connected to the rotation shaft 172 of the driven roller 174 and is engaged with the spacing cam 171. If the spacing cam 171 is rotated by the motor M2, the link member 175 moves and the rotation shaft 172 connected to the link member 175 also moves. Then the driven roller 174, which is one roller of the roller pair, spaces away from the driving roller 173, which is another roller.

In this embodiment, an occurrence of buckling and return of oblique movement of the sheet S as described above can be reduced by spacing the first registration pre-roller pair 108, if the registration unit 102 corrects oblique movement of the sheet S being fed in the single-side feeding passage 201. That is, a large distortion in the loop shape is less likely to occur since the rear end side of the sheet S is not nipped by the first registration pre-roller pair 108, if a loop is formed by abutting the leading end of the sheet S against the registration unit 102. Thus, even if the sheet is started to be fed by the registration unit 102 in this state, buckling of the sheet is less likely to occur. Especially, as shown in part (a) of FIG. 3, even if the sheet S is fed to the single-side feeding passage 201 with a gap between the sheet bundle 180 in the accommodating container 101 and the side regulating plates 181 and 182, buckling of the sheet is less likely to occur.

[Spacing Control for Correcting Oblique Movement]

Some types of sheets are less likely to have wrinkles or buckles than others. For example, thin paper tends to have wrinkles easily, while thick paper with a large basis weight is less likely to have wrinkles. Thus, in this embodiment, a first mode in which the first registration pre-roller pair 108 is spaced and a second mode in which the first registration pre-roller pair 108 is not spaced can be selectively executed according to a type of sheet during correction of oblique movement. First, the control configuration provided by the image forming apparatus 100 of this embodiment will be described with reference to FIG. 6.

As shown in FIG. 6, a control unit 300 includes a CPU (Central Processing Unit) 301, a ROM (Read Only Memory) 302, and a RAM (Random Access Memory) 303. The CPU 301 controls each portion while reading a program corresponding to the control procedure stored in the ROM 302. Working data and input data are stored in the RAM 303, and the CPU 301 controls by referring to data stored in RAM 303 based on the program as described above, etc.

The control unit 300 controls the motor M1 which drives the roller 102*a* of the registration unit 102 through a driver 304, and a motor M21 which drives the spacing mechanism 170 through a driver 305. The control unit 300 is connected to an operation portion 306 provided by the image forming apparatus 100. The operation portion (input portion) 306 is, for example, an operation panel disposed on a front side of the image forming apparatus 100, and is capable of inputting various data in addition to operating the image forming apparatus 100. The CPU 301 controls each portion based on signals input from the operation portion 306.

One example of the control of the spacing mechanism 170 according to a type of sheet performed by the control unit 300 will be described with reference to FIG. 7. Information on the type of the sheet in the accommodating container 101 is input from the operating portion 306 or a PC connected to the apparatus, etc., for example, when a user sets the sheet in the accommodating container 101. The control unit 300 identifies the type of the sheet in the accommodating container 101 from the input information (S1). The control unit 300 determines whether or not the type of sheet to be fed from the accommodating container 101 corresponds to a sheet to be likely to have wrinkles, such as thin paper (S2). For example, if a basis weight of a sheet is less than a predetermined value, it determines that the sheet corresponds to a sheet which is likely to have wrinkles.

If a sheet corresponds to a sheet that is likely to have wrinkles (Y in S2), the control unit 300 drives the motor M2 to space the first register pre-roller pair 108 by the spacing mechanism 170 (S3). Then, the feeding unit 106 starts to feed the sheet from the accommodating container 101 to the single-side feeding passage 201 (S5). That is, in this embodiment, the first registration pre-roller pair 108 is spaced by the spacing mechanism 170 before the sheet is fed by the feeding portion 106.

The fed sheet is abutted against the registration unit 102 to form a loop (S6). In this process, the sheet passes through the first registration pre-roller pair 108, which is spaced. Since the first registration pre-roller pair 108 is spaced even when the sheet is forming a loop, a distortion of the loop is reduced. Then, at a predetermined timing, the motor M1 is driven to start a rotation of the rollers 102*a* of the registration unit 102 (S7), and the sheet is fed by the registration unit 102 (S8).

On the other hand, if the sheet does not correspond to a sheet that is likely to have wrinkles in S2 (N in S2), the feeding portion 106 starts feeding the sheet (S5) while the first registration pre-roller pair 108 remains contacting (S4). A subsequent process is similar to S6 to S8 as described above, except that the first registration pre-roller pair 108 has not been spaced. Thus, the control portion 300 can selectively execute the first mode and the second mode according to a type of a sheet. The first mode is a mode in which the first registration pre-roller pair 108 is spaced, when oblique movement of a sheet is being corrected by the registration unit 102. The second mode is a mode in which the first registration pre-roller pair 108 is not spaced, even when oblique movement of a sheet is being corrected by the registration unit 102.

[For Correcting Oblique Movement of a Sheet Fed in the Double-Side Feeding Passage]

As described above, when correcting oblique movement of the sheet S that is fed in the single-side feeding passage 201, an occurrence of wrinkles etc. of the sheet S can be reduced by spacing the first registration pre-roller pair 108. On the other hand, when a sheet S is fed in the double-side feeding passage 202, the sheet S fed by the second registration pre-roller pair 109 passes through the curved portion 202*a* and abuts against the registration unit 102 to correct oblique movement.

The sheet S reaching the double-side feeding passage 202 passes through the secondary feeding portion 103 and the fixing device 150, is reversed in the reversing portion 164 in an upper part of the apparatus, and is fed to the double-side feeding passage 202, after correcting oblique movement of the sheet S in the single-side feeding passage 201. Then, the sheet S passes through the double-side feeding passage 202 and merges with the single-side feeding passage 201 at the merging portion 203, and an oblique movement of the sheet S is corrected by the registration unit 102. Since the sheet S which passes through the double-side feeding passage 202 takes a long passage to reach the registration unit 102, even if oblique movement of the sheet S is corrected in the single-side feeding passage 201, it will be fed obliquely again.

Since oblique movement of the sheet S which reaches at the double-side feeding passage 202 has been corrected by the registration unit 102 in the single-side feeding passage 201, the amount of the obliqueness is not large. For example, it is unlikely that the sheet S is fed to the double-side feeding passage 202 in such a condition that oblique movement of the sheet S is large due to a gap between the sheet bundle 180 and the side regulating plates 181 and 182 as shown in FIG. 3A. In this embodiment, the double-side feeding passage 202 includes a curved portion 202*a* on a downstream side of a sheet feeding direction of the second registration pre-roller pair 109. Thus, if the sheet S is abutted against the registration unit 102 to correct oblique movement, the sheet S is curved along the curved portion 202*a*.

Therefore, if the second registration pre-roller pair 109 is spaced while correcting oblique movement in the same way as the first registration pre-roller pair 108 is spaced in the single-sided feeding passage 201, a force of abutting the sheet S against the registration unit 102 may not be enough. As a result, correction of oblique movement may not be performed securely. For this reason, it is preferable that the sheet S is nipped by the second registration pre-roller pair 109 to secure the force of abutting the sheet S, when the sheet S is abutted against the registration unit 102 from the double-side feeding passage 202. As described above, in this embodiment, oblique movement of the sheet S fed from the double feeding passage 202 is corrected by utilizing a moving mechanism 190 which is a sliding mechanism as shown in FIG. 8, instead of utilizing a spacing mechanism in the second registration pre-roller pair 109 of the double-side feeding passage 202.

[Sliding Mechanism]

The sliding mechanism 190 will be described in FIG. 8 with reference to FIG. 2. As shown in FIG. 2, the second registration pre-roller pair 109 is comprised of a driving roller 191 and a driven roller 192. As shown in FIG. 8, the sliding mechanism 190 is capable of sliding the driven roller 192, which is at least one of the rotators which configures the second registration pre-roller pair 109, in the width direction crossing the sheet feeding direction. As shown in FIG. 2, the driven roller 192 is a roller which is arranged on an outside as seen from the curvature center of the curved portion 202*a*. Thus, the sheet S, which is nipped and fed by the second registration pre-roller pair 109 and is abutted against the registration unit 102 through the curved portion 202*a*, strongly contacts an outside of the curvature, that is, a side of the driven roller 192 side. Therefore, if oblique movement of the sheet S is corrected, a greater force from the sheet S acts on the driven roller 192 side than on the driven roller 191 side. In this embodiment, the driven roller 192 is capable of sliding in the width direction of the sheet, but the driving roller 191 may also be capable of sliding in the width direction.

The driven rollers 192 are arranged around a rotation shaft 192*a* so that they are capable of moving in the direction of the rotational axis. In this embodiment, two driven rollers 192 are provided on the rotation shaft 192*a* at a distance from each other. The width direction of the sheet as described above is generally parallel to the direction of the rotational axis of the driven roller 192. Two driving rollers 191 are also provided on the rotational axis so as to form a nip portion that nips the sheet with the driven roller 192.

The sliding mechanism 190 includes coil springs 193 as elastic members and regulating portions 194. A pair of the coil springs 193 are arranged on both sides of the rotational axis direction of each driven rollers 192. A pair of the regulating portions 194 are arranged so as to hold one pair of coil springs 193 with each of the driven rollers 192, and are not capable of moving in the rotational axis direction with respect to the rotation shaft 192*a*. In this embodiment, the regulating portions 194 also serves as bearings of the rotating shaft 192*a*. That is, the driven rollers 192 are arranged between a pair of regulating portions 194. The coil springs 193 are arranged between one side of the regulating portion 194 and one end of the driven roller 192, and between the other side of the regulating portion 194 and the other end of the driven roller 192. The rotation shaft 192*a* passes through inside each of coil springs 193.

In the sliding mechanism 190, if the driven roller 192 moves in the sliding direction by a force generated in a direction to reduce a loop distortion of the sheet S during correcting oblique movement, the coil springs 193 on the moving direction side is compressed. At this time, since both of the two driven rollers 192 are capable of moving in a width of a sheet, each driven roller moves according to a distortion condition of a sheet being fed. And then, once the roller 102*a* of the registration unit 102 rotates, the sheet S is fed, and the sheet S passes through the driven roller 192, the compressed coil spring 193 intends to return to its original length by a spring force. By this, the driven roller 192, which has been slidden, returns to an original position and prepares for a feeding process of a next sheet to be fed. With the above configuration, it is possible to reduce a loop distortion during correcting oblique movement of the sheet S in the double-side feeding passage 202 by utilizing a simple and smaller configuration than the spacing mechanism 170, which enables the driven roller 192 of the second registration pre-roller pair 109 to slide.

On the other hand, since the sliding mechanism 190 as described above is configured with coil springs 193 at both ends of the driven roller 192, if oblique movement of a sheet S with a large obliqueness is corrected, a distortion of a loop becomes larger and an amount of movement of the driven roller 192 in the sliding direction becomes larger. Therefore, if an amount of movement becomes large, spring force of the coil springs 193 becomes large, which may prevent smooth movement in a direction of sliding.

However, as described above, an amount of oblique movement of the sheet S fed into the double-side feeding passage 202 is smaller than that of the sheet fed with a gap between the sheet bundle 180 and the side regulating plates 181 and 182 in the accommodating container 101, for example. Therefore, it is possible to prevent wrinkles and return of oblique movement of the sheet S fed in the double-side feeding passage 202 during correcting oblique movement by the sliding mechanism 190, which is simple and has smaller configuration than the spacing mechanism 170 as described above.

In this embodiment configured in this way, while suppressing an increase in the size of the apparatus, oblique movement of a sheet is properly corrected with a configuration which has the single-side feeding passage 201 and the double-side feeding passage 202. That is, in the single-side feeding passage 201, where the sheet S may be fed with a large amount of oblique movement, an occurrence of wrinkles etc. are suppressed during correcting oblique movement by providing the spacing mechanism 170 which space the first registration pre-roller pair 108. On the other hand, in the double-side feeding passage 202, where the sheet S which is less likely to increase an amount of oblique movement is fed, an occurrence of wrinkles etc. of the sheet is suppressed during correcting oblique movement of the sheet by providing the sliding mechanism 190 to slide the driven roller 192 of the second registration pre-roller pair 109. Since the sliding mechanism 190 has a simpler and smaller configuration than the spacing mechanism 170, an occurrence of wrinkles etc. of the sheet during correcting oblique movement of the sheet is reduced while suppressing an increase in the size and complexity of the apparatus. Furthermore, a distance between the first registration pre-roller pair and the registration roller pair in the first feeding passage is smaller than a distance between the second registration pre-roller pair and the registration roller pair in the second feeding passage. That is, with respect to distances between the registration roller pair and the registration pre-roller pair, a spacing mechanism is provided with the first registration pre-roller pair of a shorter distance and a sliding mechanism is provided with the second registration pre-roller pair of a longer distance. Thus, by providing the spacing mechanism and the sliding mechanism according to distances between the rollers, it is possible to suppress wrinkles and other problems that may occur in the sheet while reducing costs.

Second Embodiment

The second embodiment will be described with reference to FIG. 9. In the first embodiment as described above, a timing for spacing the first registration pre-roller pair 108 by the spacing mechanism 170 is before a sheet is fed. On the other hand, in this embodiment, a timing for spacing is after a sheet is abutted against the registration unit 102. Following descriptions focus on points which differ from the first embodiment. Since the other configurations and functions are the same as those of the first embodiment as described above, the same symbols will be used for the same configurations to skip illustrations and descriptions.

In the first embodiment as described above, since the first registration pre-roller pair 108 is spaced when the sheet S is abutted against the registration unit 102, the abutting force of the sheet S may not be stably obtained. Thus, in this embodiment, the sheet S is abutted against the registration unit 102 while the sheet S is nipped by the first registration pre-roller pair 108, and after abutting the sheet S, the first registration pre-roller pair 108 is spaced.

One example of the ways how to control the spacing mechanism 170 in this embodiment will be described with reference to FIG. 9. Similar to the first embodiment, when a user sets sheets in the accommodating container 101 or the like, information on a type of the sheets in the accommodating container 101 is input from the operation portion 306 or a PC connected to the apparatus. The control unit 300 identifies the type of the sheets in the accommodating container 101 from the input information (S11). And the control unit 300 starts to feed a sheet from the accommodating container 101 to the single-side feeding passage 201 by the feeding unit 106 (S12). Then, the fed sheet is abutted against the register unit 102 to form a loop (S13).

In this embodiment, in order to stabilize the abutting force of the sheet S against the registration unit 102, the first registration pre-roller pair 108 has not been spaced and the sheet S has been nipped, until a leading end of the sheet S is abutted against the nip line of the pair of rollers 102*a* of the registration unit 102 to form a loop.

At a predetermined timing, the motor M1 is driven to start a rotation of the roller 102*a* of the registration unit 102 (S14). At this time, the control unit 300 determines whether or not a type of sheet to be fed from the storage 101 corresponds to a sheet which is likely to have wrinkles such as thin paper (S15). For example, if a basis weight of a sheet is less than a predetermined value, it is determined that the sheet corresponds to a sheet which is likely to have wrinkles.

If the sheet corresponds to a sheet which is likely to have wrinkles (Yin S15), the control unit 300 drives the motor M2 to space the first registration pre-roller pair 108 by the spacing mechanism 170 (S16). Then, the sheet is fed by the registration unit 102 (S18). On the other hand, if the sheet does not correspond to a sheet that is prone to wrinkling in S15 (N in S15), the first registration pre-roller pair 108 is left in the attached state (S17), and the sheet is fed by the registration unit 102 (S18).

In this embodiment, since it is easy to secure the abutting force of the sheet S against the registration unit 102, oblique movement of the sheet S is corrected more securely.

Other Embodiments

As described above, in each embodiment, a sheet feeding device is applied to an image forming apparatus, however, it may be applied to other than imaging forming apparatus. For example, a sheet feeding device may be applied to a configuration, which has two feeding passages, such as an image reading device which reads images on a sheet while feeding the sheet, or a sheet processing device which perform a process such as stapling the sheet. An image forming apparatus may be a copier, a fax, a multifunction machine, etc., other than a printer.

In the embodiments as described above, a configuration utilizing a registration roller pair as an oblique movement correction portion is described, however, an oblique movement correction portion may be a so-called registration shutter which correct oblique movement by abutting the leading end of a sheet against a shutter. A rotatable member pair such as a first rotatable member pair and a second rotatable member pair may be a configuration such as a pair of belts or a belt and a roller, other than a roller pair.

The present invention may also be realized by supplying a program which realizes one or more of functions in the embodiments described above to a system or a device through a network or a storage medium, and by a process in which one or more processors in a computer of the system or the device read and execute the program. It may be realized by a circuit (ASIC etc.) which realizes one or more functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-132530 filed Aug. 4, 2020, which is hereby incorporated by reference herein in its entirety.

What is claimed is:

1. A sheet feeding device comprising:

a sheet cassette configured to accommodate a sheet;

a feeding portion configured to feed a sheet accommodated in said sheet cassette;

a first feeding roller pair configured to nip and feed the sheet fed by said feeding portion, wherein a nip portion of said first feeding roller pair is capable of being spaced away;

a registration roller pair configured to nip and feed the sheet by forming a nip portion, said registration roller pair correcting oblique movement of the sheet by abutting a leading end of the sheet fed by said first feeding roller pair against said nip portion of said registration roller pair;

a first sheet feeding passage provided between said first feeding roller pair and said registration roller pair with respect to a sheet feeding direction, through which the sheet fed by said first feeding roller pair is passed;

a reversing portion provided downstream of said registration roller pair with respect to the sheet feeding direction and configured to reverse the sheet;

a second sheet feeding passage, provided between said reversing portion and a merging point where the sheet fed by said reversing portion merges with said first sheet feeding passage downstream of said first feeding roller pair and upstream of said registration roller pair; and a second feeding roller pair, provided in said second sheet feeding passage between said reversing portion and said merging point, and configured to nip and feed the sheet, reversed by said reversing portion, to said registration roller pair, wherein no other feeding roller pair is provided in between said first feeding roller pair and said registration roller pair in first sheet feeding passage, wherein a distance between said first feeding roller pair and said registration roller pair in first sheet feeding passage is smaller than a distance between said second feeding roller pair and said registration roller pair in second sheet feeding passage, and wherein said second feeding roller pair includes (1) a feeding roller for feeding the sheet and (2) a driven roller driven by rotation of said feeding roller, said driven roller being movable with respect to a sheet width direction perpendicular to the sheet feeding direction.

2. A sheet feeding device according to claim 1, wherein said second sheet feeding passage includes a curved portion, and wherein said driven roller is disposed outside of said curved portion.

3. A sheet feeding device according to claim 1, further comprising:

a driven roller shaft configured to rotatably support said driven roller;

an elastic member provided on both sides of said driven roller with respect to a rotational axis direction and configured to urge said driven roller with respect to the rotational axis direction; and a restricting portion provided on both sides of said driven roller with respect to the rotational axis direction and configured to restrict said elastic member with respect to the rotational axis direction.

4. A sheet feeding device according to claim 3, wherein said driven roller includes (1) a first driven roller and (2) a second driven roller, said first driven roller and said second driven roller being provided at an interval with respect to the rotational axis direction, and wherein said first driven roller and said second driven roller are mutually independently movable with respect to the rotational axis direction.

5. A sheet feeding device according to claim 1, further comprising a control portion configured to control said nip portion of said first feeding roller pair between a spaced state and a contact state, wherein said control portion is configured to selectively execute an operation between (1) a first mode in which said first feeding roller pair is spaced away while an oblique movement of the sheet is corrected by said registration roller pair and (2) a second mode in which said first feeding roller pair is not spaced away while the oblique movement of the sheet is corrected by said registration roller pair according to a kind of the sheet.

6. A sheet feeding device according to claim 1, wherein the nip portion of said second feeding roller pair is not spaced away and said driven roller is moved with respect to the sheet width direction.

7. A sheet feeding device according to claim 1, further comprising a motor configured to drive to switch between (1) a spaced state in which said nip portion of said first feeding roller pair is spaced away and (2) a contact state in which said nip portion of said first feeding roller pair is in contact, wherein said first feeding roller pair is changed between said spaced state and said contact state by said motor, wherein no other motor which is configured to switch between a spaced state in which said nip portion of said second feeding roller pair is spaced away and a contact state in which said nip portion of said second feeding roller pair is in contact is provided, and wherein said second feeding roller pair is movable in accordance with the movement of the sheet in a width direction.

* * * * *